US007038199B2

(12) United States Patent
Kalinitchenko

(10) Patent No.: US 7,038,199 B2
(45) Date of Patent: May 2, 2006

(54) APPARATUS AND METHOD FOR ELEMENTAL MASS SPECTROMETRY

(75) Inventor: Iouri Kalinitchenko, Mulgrave (AU)

(73) Assignee: Varian Australia PTY LTD, Mulgrave (AU)

( * ) Notice: Subject to any disclaimer, the term of this patent is extended or adjusted under 35 U.S.C. 154(b) by 66 days.

(21) Appl. No.: 10/489,215

(22) Filed: Mar. 9, 2004

(65) Prior Publication Data

US 2005/0199795 A1 Sep. 15, 2005

Related U.S. Application Data

(63) Continuation of application No. PCT/AU02/01239, filed on Sep. 10, 2002.

(30) Foreign Application Priority Data

Sep. 10, 2001 (AU) ..... PR7593

(51) Int. Cl.
*H01J 49/06* (2006.01)

(52) U.S. Cl. ..... 250/288; 250/281; 250/282; 250/427

(58) Field of Classification Search ..... 250/288, 250/281, 282, 427
See application file for complete search history.

(56) References Cited

U.S. PATENT DOCUMENTS 5,256,874 A * 10/1993 Chutjian ..... 250/288
5,514,868 A * 5/1996 Dixon ..... 250/282
6,649,907 B1 * 11/2003 Ebeling et al. ..... 250/288
2004/0155180 A1 * 8/2004 Zubarev ..... 250/281

FOREIGN PATENT DOCUMENTS

WO WO 02/078048 A1 * 10/2002

* cited by examiner

*Primary Examiner*—Jack I. Berman
(74) *Attorney, Agent, or Firm*—Bella Fishman

(57) ABSTRACT

A mass spectrometer and method of mass spectrometry in which polyatomic and doubly charged ion interferences are attenuated by establishing an electron population through which a beam of particles containing elemental sample ions and the interfering ions is passed such that the interfering ions preferentially undergo ion-electron recombination and thus dissociation to remove a significant number of the interfering ions. Means (30 or 32) for providing a population of electrons (34 or 36) in an ICP-MS (22) may comprise a magnetic field means such as an electric coil, or an electron generating device. The population of electrons has an electron number density ($>10^{11}$ $cm^{-3}$ to $10^{14}$ $cm^{-3}$), a free electron energy (>0.01 eV to <5 eV) in a region at a low pressure (<10 Torr), such that for a predetermined path length (1–4 cm) of the ions through the electron population, the interfering ions will preferentially be attenuated by the dissociative recombination process. The ion beam (40) then passes to a mass analyser (42) and ions which have been separated according to their mass-to-charge ratio are detected by ion detector (44).

21 Claims, 3 Drawing Sheets

APPARATUS AND METHOD FOR ELEMENTAL MASS SPECTROMETRY

This appln. is a CON of PCT/AU02/01239 filed on Sep. 10, 2002.

TECHNICAL FIELD

The present invention relates to an apparatus and method for mass spectrometry, in particular for elemental or isotopic analysis of a sample by mass spectrometry.

BACKGROUND

Elemental or isotopic analysis by mass spectrometry is known to be subject to interference from polyatomic and doubly charged ions. Interference arises when an ion has a mass-to-charge ratio that, within the limits of resolution of a mass spectrometer being used, is the same as that of an isotope of analytical interest. Such interferences can compromise the detection limits and dynamic range of the analysis, and can be particularly troublesome when an element of interest has but one isotope. It is known that an inductively coupled plasma (ICP) ion source is capable of generating many oxide, hydroxide, and doubly charged ion interferences. Other types of sources for atomising and ionizing a sample for elemental analysis by mass spectrometry such as for example Microwave Induced Plasmas, Laser Induced Plasmas, and Glow Discharges also produce interfering ions.

An object of the present invention is to provide an apparatus and method for mass spectrometry in which such polyatomic and doubly charged ion interferences are attenuated.

SUMMARY OF THE INVENTION

The present invention involves establishing conditions during mass spectrometry that cause polyatomic or doubly charged ions to preferentially undergo ion-electron recombination and thus disassociation in the presence of free electrons thereby removing a significant number of such interfering ions. A significant number of the interfering ions is such as will result in detectable improvements in the limit of detection of a mass spectrometer for trace amounts of an isotope. Usually this will involve removal of a substantial number of the interfering ions.

Accordingly, in a first aspect, the present invention provides a mass spectrometer for elemental analysis of a sample including source means for atomising a portion of the sample, means for extracting a beam of particles from the source means, wherein the beam contains elemental sample ions and interfering polyatomic or doubly charged ions, means for providing a population of electrons in a region through which the beam of particles is passed and which defines a predetermined path length for the particles through the electron population, said region being located within an evacuable chamber of the mass spectrometer whereby a low pressure is establishable in said region, the population of electrons having an electron number density and free electron energy which, together with said predetermined path length and low pressure, provide for interfering polyatomic or doubly charged ions preferentially to undergo ion-electron recombination and thus dissociation thereby removing a significant number of the interfering ions from the beam of particles, a mass analyser and an ion detector for receiving ions from the beam of particles after it has passed through the population of electrons for spectrometric analysis whereby concentrations of different elements in the sample are determinable.

In a mass spectrometer in which an inductively coupled plasma (ICP) is used to atomise a portion of the sample, the means for providing the population of electrons may be a device for providing a magnetic field for temporarily confining electrons from the plasma to a region defined by the magnetic field. Such a magnetic field may be provided by one or more electric coils, magnets or any other means of creating a suitable magnetic field. Indeed any "magnetic mirror" device, that is a device capable of creating a non-uniform (electron confining) co-axial magnetic field, may be used to confine electrons and ions along the axis of the magnetic field. Such a device, be it an electric coil or otherwise, may be placed behind a sampler cone or behind a skimmer cone, or such devices could be provided behind both the sampler and skimmer cones. This is applicable to any known plasma ion source for elemental analysis (ICP, Microwave Induced Plasma, Laser Induced Plasma, Glow Discharge Plasma), where free electrons already exist due to the ion-electron balance in the original plasma.

Alternatively the means for providing a population of electrons includes a reaction cell through which the beam of particles is passed, the reaction cell being located within said evacuable chamber of the mass spectrometer and having a plasma generating means associated with it for supplying a plasma into the reaction cell whereby the plasma electrons constitute said population of electrons.

In the first aspect of the invention, the means for providing the population of electrons, for example the plasma ion source in an ICP-Mass Spectrometer, or a separately supplied plasma to a reaction cell, does not provide for control over at least the free electron energy, nor to an extent over the electron number density, beyond the values for these parameters that derive from the plasma as such. In alternative apparatus, electrons may be created separately in which case the electron number density and free electron energy of such electrons may be established as required.

Thus according to a second aspect, the present invention provides a mass spectrometer for elemental analysis of a sample including source means for atomising a portion of the sample, means for extracting a beam of particles from the source means, wherein the beam contains elemental sample ions and interfering polyatomic or doubly charged ions, means for providing a population of electrons in a region through which the beam of particles is passed and which defines a predetermined path length for the particles through the electron population, said region being located within an evacuable chamber of the mass spectrometer whereby a low pressure is establishable in said region, said means for providing the population of electrons also allowing establishment of an electron number density and free electron energy for the population of electrons which, together with said predetermined path length and low pressure, provide for interfering polyatomic or doubly charged ions preferentially to undergo ion-electron recombination and thus dissociation thereby removing a significant number of the interfering ions from the beam of particles, a mass analyser and an ion detector for receiving ions from the beam of particles after it has passed through the population of electrons for spectrometric analysis whereby concentrations of different elements in the sample are determinable.

In the second aspect of the invention the means for providing the population of electrons is preferably an electron generating device by means of which the required electron number density and free electron energy for the population of electrons can be established. This electron generating device is preferably configured and operated to confine the so-created electrons thus establishing an electron population through which the beam of particles is passed.

The electron generating device may comprise a tubular electron emitting cathode within which is located a tubular mesh electrode that is operable as an electron attracting anode, whereby a required electron number density can be established. The electron generating device may furthermore include a second tubular mesh electrode located within the first described tubular mesh electrode (that is, the anode), which is operable via application of a suitable potential thereto to establish a suitable free electron energy for the population of electrons within the device.

As an alternative to configuring the electron generating device to confine the generated electrons, the arrangement may be such that the generated electrons are magnetically confined to provide the population thereof.

An electron generating device as in embodiments of the second aspect of the invention may be used with plasma source mass spectrometers for elemental analysis such as ICP-MS, Microwave Induced Plasma MS, Laser Induced Plasma MS, Glow Discharge Plasma MS.

According to a third aspect, the present invention provides a method for elemental mass spectrometry of a sample including removing polyatomic or doubly charged ion interferences, the method including atomising a portion of the sample and creating a beam of particles therefrom, wherein the beam contains elemental sample ions and interfering polyatomic or doubly charged ions, establishing a population of electrons having an electron number density and free electron energy in a region at a predetermined low pressure, passing the beam of particles through the population of electrons, the beam of particles having a predetermined path length through the population of electrons, wherein said electron number density, free electron energy, low pressure and path length are such that interfering polyatomic or doubly charged ions contained in the beam preferentially undergo ion-electron recombination and thus disassociation thereby removing a significant quantity of such ions from the beam, and spectrometrically analysing the masses of ions in the resultant beam to determine the elemental composition of the sample.

The step of establishing the population of electrons may involve generating a plasma by which the portion of a sample is atomised and providing a magnetic field to establish the population of electrons, the magnetic field being located and shaped to confine electrons from the plasma to a region.

Alternatively, the population of electrons may be established by supplying a plasma into the region, for example into a reaction cell through which the beam of particles is passed, whereby the plasma electrons constitute the population of electrons.

Alternatively the population of electrons may be established by creating electrons using an electron generating device, and confining the so created electrons to establish the population of electrons.

Values for the electron number density ($n_e$), free electron energy ($E_e$), pressure (P) and path length are—

Electron number density ($n_e$)>$10^{11}$ $cm^{-3}$ to $10^{14}$ $cm^{-3}$, preferably $10^{12}$ to $10^{14}$ $cm^{-3}$, more preferably $10^{13}$ to $10^{14}$ $cm^{-3}$.

Free electron energy ($E_e$)>0.01 eV to <5 eV, preferably approximately 1 eV.

Pressure (P)<10 Torr, preferably <$10^{-3}$ Torr.

Path length 1 to 4 cm, preferably 2 to 4 cm, more preferably 3 to 4 cm.

The invention includes magnetic confinement of electrons from the plasma together with use of an electron generating device. The electrons from the electron generating device may be magnetically confined to form a population thereof, or the device may be configured and operable to confine the generated electrons and thus form a population thereof, or both. The invention includes use of a plurality of electron generating devices.

Theoretical Basis for the Invention

Theoretical considerations to support the invention will now be described.

The idea underlying the invention is that interfering polyatomic and doubly-charged ions can be removed by preferential ion-electron recombination in the presence of free electrons.

The theory of ion-electron recombination will now be presented, to provide a basis for understanding the invention.

Ion-electron Recombination

Ion-electron recombination is one of the known electron loss mechanisms in plasmas.

The characteristic plasma decay time $t_r$ is given by:

$$t_r=1/(\beta n_e^0)$$

where $n_e^0$ is the initial electron density (number of electrons per unit volume), and β is the ion-electron recombination coefficient (unit volume times the number of ion-electron recombinations per unit time). Values of β for several gaseous ions are shown in Table 1.

TABLE 1

Recombination of electrons and various gaseous ions (reference: 'Ionized Gases', A. von Engel, 2nd edition, Oxford, 1987, p. 163)

| Gas | β, $cm^3/s$ | P, mm Hg | $T_e$, eV |
|---|---|---|---|
| Ar | $3 \cdot 10^{-7}$ | 15–30 | 0.03 |
| $H_2$ | $<3 \cdot 10^{-8}$ | 3–12 | 0.03 |
| $O_2$ | $2.7 \cdot 10^{-7}$ | 2–20 | 0.03 |
| $N_2$ | $10^{-7}$ (?) | 2–5 | 0.03 |
| Cs | $3–4 \cdot 10^{-10}$ | 0.01–0.1 | 0.15 |
| Hg | $\sim 2 \cdot 10^{-10}$ | 0.3 | 0.15 |

In Table 1, P is the gas pressure in millimeters of mercury (mm Hg). $T_e$ is the temperature of the plasma electrons. The unit of measurement is electron-Volts (eV).

Dissociative Recombination of Polyatomic Ions

The dissociative recombination of a polyatomic ion $A_2^+$ is described by:

$$A_2^+ + e = A + A + E$$

where e is an electron, A is a neutral atom and E is the energy balance.

For example, for the argon dimer ion:

$$Ar_2^+ + 1.4\ eV = Ar^+ + Ar;$$

$$Ar + 15.8\ eV = Ar^+ + e$$

$$Ar_2^+ + e = Ar + Ar + 14.4\ eV.$$

The energy of creation of two neutral argon atoms from dissociative recombination of an argon dimer ion (14.4 eV) is well above the energy of creation of a metastable argon atom (Ar*: 11.55 eV, 11.61 eV, or 11.72 eV). That is why dissociative recombination of $Ar_2^+$ usually produces a metastable atom (Ar*) and a stable neutral atom (Ar).

The dissociative recombination coefficient for electrons and gaseous diatomic argon ions ($Ar_2^+$) is of the order of $10^{-7}$ $cm^3/s$ (reference: 'Physics of Gas Discharge', Y. P. Raizer, Science, Moscow, 1987, p. 139)

Conversion Reaction Generating $A_2^+$

The reaction $$A+A+(\text{kinetic or excitation energy})=A_2^++e$$

generates polyatomic ions. It involves a third particle, usually another atom. The rate of conversion is given by:

$$d(n_{A2}+)/dt=kn_A$$

where k is the conversion rate constant (in units of volume to the sixth power per unit time) and n denotes the number of species per unit volume. Some measured values of k are given in Table 2.

TABLE 2

Measured conversion rate constants (k) for different monatomic gases (reference: 'Physics of Gas Discharge', Y. P. Raizer, Science, Moscow, 1987, p. 141)

| Gas | k, $10^{-31}$ $cm^6/s$ |
|---|---|
| He | 0.63–1.15 |
| Ne | 0.42–0.79 |
| Ar | 1.46–3.9 |
| Kr | 1.9–2.7 |
| Xe | 3.6 |
| Hg | 1 |
| Cs | 150 |

Application of Electron-ion Recombination to Interference Removal in Elemental Mass Spectrometry First, conditions have to be chosen to favour the dissociation of polyatomic ions over the reverse reaction. Secondly, possible mechanisms for the loss of analyte ions have to be considered.

Generation of Polyatomic Ions by Means of an Associative Conversion Reaction

The associative conversion reaction $$B^++A=AB^+$$

can happen in regions of relatively high pressure and small electron density. The lifetime, $\tau_{conv}$, of the monatomic ion, is given by $$\tau_{conv}=1/(k\cdot(n_A)^2)$$

For example, consider the formation of the diatomic argon ion $Ar_2^+$ by this process. If the Ar gas pressure is 10 Torr ($n^{Ar}=3.3\times10^{17}$ $cm^{-3}$). The lifetime of an $Ar^+$ ion before it converts to a $Ar_2^+$ ion by associative conversion is $$1/(k\cdot n_{Ar}^2)=1/(10^{-31}\ cm^6/s\cdot10^{35}\ cm^{-6})=10^{-4}s.$$

Compare this with the rate of dissociative recombination at the same pressure, with an electron concentration of $n^e=10^{11}$ $cm^{-3}$ and $\beta=10^{-7}$ $cm^3/s$ [typical values]. The recombination time $t_r$ is given by $$t_r=1/(\beta n_e^0)=1/(10^{-7}\ cm^3/s.\ 10^{11}\ cm^{-3})=10^{-4}s.$$

In this case $\tau_{conv}=t_{rec}=10^{-4}s$. Therefore a pressure of 10 Torr and a plasma electron density of $n_e=10^{11}$ $cm^{-3}$ is enough to have the molecular dissociative recombination process balanced by the associative conversion process. This implies that with pressures lower than 10 Torr and with $n_e$ higher than $10^{11}$ $cm^{-3}$ dissociative recombination must prevail over associative conversion.

Radiative Recombination

This process is represented by $$A^++e=A+h\nu$$

where hν represents electromagnetic radiation (light) that carries away the energy released in the recombination. The radiative recombination mechanism does not represent any danger (at least theoretically) for significant loss of analyte ions.

Radiative Recombination in a Three-Body Collision

This process is represented by $$A^++e+e=A+e+h\nu$$

In this case the energy released in the recombination is distributed between electromagnetic radiation (hν) and the increased kinetic energy of the second electron. Theoretically this may represent another mechanism for the loss of analyte ions, but it can be considered negligible.

Dissociative Electron Attachment to Molecular Polyatomic Ions

In this reaction an electron attaches itself to a polyatomic ion, and the energy of the collision breaks the bond between the atoms making up the ion.

$$AB^++e=A+B$$

This mechanism favours the loss of polyatomic ions. The reaction has a coefficient of attachment $\beta_{da}=3.4\cdot10^{-8}$ $cm^3/s$, which can favour the dissociation of polyatomic ions.

Electron Characteristics Favouring Dissociative Ion-electron Recombination

The free electron energy $E_e$ should be ~1 eV. On one hand $E_e$ should not be very small, that is, not less then 0.01 eV, to avoid enhancing the rate of three-body radiative recombination relative to dissociative recombination. On the other hand, $E_e$ should be less then 5 eV because this avoids additional electron impact ionisation of the neutrals and metastables.

The number density of free electrons $n_e$ is ~$10^{13}$–$10^{14}$ $cm^{-3}$.

The volume V where free electrons are generated is 1–4 $cm^3$.

The ion current $I^+$ in a typical ICP-MS instrument is 0.1–1 μA.

The ion velocity is ~2 mm/μs. This is the speed of $Ar_2^+$ at the ion energy ~10 eV.

Theoretical Estimates of Polyatomic Ion Attenuation

In this section it is assumed that a population of electrons has been generated in an electron-generating device of the invention which is described hereinbelow, called an Electron Reaction Cell (ERC). A plasma ion beam is assumed to pass through the electron population, which is assumed to fill the ERC.

Gas, preferably hydrogen may be injected into the ERC using a separate injection port. This gas at a pressure of preferably $10^{-3}$–$10^{-1}$ Torr, may be used to generate sufficient ion density r to compensate possible electron space charge effect. The ion density may be generated by means of electron-neutral impact mechanism or any other known phenomena. In some specific cases the pressure may be much higher, for example 1 Torr, in which case the ERC dimensions may be significantly reduced down to a length L=0.5–1 cm.

The electron-ion recombination coefficient is of the order of $\beta=10^{-7}$ $cm^3/s$ for most polyatomic ions in ICP-MS. This value is used in the following calculations. ERC lengths of 1 cm, 2 cm and 4 cm and different electron densities $n_e=10^{13}$ $cm^{-3}$, $n_e=2\cdot10^{13}$ $cm^{-3}$ and $n_e=10^{14}$ $cm^{-3}$ will be considered. It is assumed the electron energy is 1 eV and the gas pressure in the ERC volume is $10^{-2}$–$10^{-4}$ Torr. The pressure of a gas, preferably hydrogen, supplied into the ERC can be adjusted in order to generate sufficient electron density though the electron-neutral impact mechanism to prevent possible electron space charge effect.

1) $n_e\sim10^{13}$ $cm^{-3}$

From $t_r=1/(\beta n_e)$ the speed of polyatomic recombination to the 50% level equals 1 μs.

ERC 1 cm Long.

The time an argon dimer ion $Ar_2^+$ spends inside a 1 cm long ERC at a speed of 2 mm/μs is t=5 μs or $5\tau_r$. Polyatomic attenuation $\alpha Ar_2^+=2^5=32$.

ERC 2 cm Long.

The time an $Ar_2^+$ ion spends inside a 2 cm long ERC is t=20 μs or $10\tau_r$. Polyatomic attenuation $\alpha Ar_2^+$ in a 2 cm ERC using the above conditions can be $\alpha Ar_2^+=2^{10}=1024$.

ERC 4 cm Long

The time an $Ar_2^+$ ion spends inside a 4 cm long ERC is t=20 μs or $20\tau_r$. Polyatomic attenuation $\alpha Ar_2=2^{20}=1048576$, i.e. ~1 million.

Analyte Ion Loss Due to Recombination Inside the ERC

For the calculations we have chosen Cs as the analyte:

$$\beta_{Cs}\sim10^{-10}\ cm^3/sec$$

and applied the formula (1) $t_r=1(\beta n_e^0)$,

Results of calculations such as that illustrated in the previous section are summarised in Table 4.

TABLE 4

Attenuation of Cs+ and $Ar_2$+ ions in electron reaction cells of various lengths and with various electron densities.

| $n_e$, $cm^{-3}$ | $\alpha Cs^+$ | $\alpha Ar_2^+$ | $\alpha Ar_2/\alpha Cs^+$ |
|---|---|---|---|
| | | 1 cm long ERC | |
| $10^{13}$ | 1.005 | 32 | 32/1.005 |
| $2\times10^{13}$ | 1.01 | 1000 | 1000/1.01 |
| $10^{14}$ | 1.025 | $10^{15}$ | $10^{15}$/1.025 |
| | | 2 cm long ERC | |
| $10^{13}$ | 1.005 | 1000 | 1000/1.005 |
| $2\times10^{13}$ | 1.01 | $10^6$ | $10^6$/1.01 |
| $10^{14}$ | 1.05 | $10^{30}$ | $10^{30}$/1.05 |
| | | 4 cm long ERC | |
| $10^{13}$ | 1.01 | $10^6$ | $10^6$/1.01 |
| $2\times10^{13}$ | 1.02 | $10^{12}$ | $10^{12}$/1.05 |
| $10^{14}$ | 1.1 | $10^{60}$ | $10^{60}$/1.1 |

$\alpha Cs^+$ = caesium (i.e. an analyte ion) signal attenuation,
$\alpha Ar_2^+$ = argon dimer (ie a polyatomic ion) attenuation Conclusions Drawn from the Theoretical Background Polyatomic ion attenuation of $1\times10^{60}$ with only 10% loss of analyte ion intensity is at least theoretically possible (that is, with $n_e=10^{14}$ $cm^{-3}$, $E_e\sim1$ eV, ERC=4 cm long, Pressure (P)=$10^{-4}$–$10^{-2}$ Torr)

It is noteworthy that a 4 cm long ERC could be capable of significant attenuation of interferences with about the same density of electrons (~$10^{13}$ $cm^{-3}$) as the density of free electrons in the argon plasma commonly used for ICP-MS. Thus, by simply preserving the plasma electrons, it is theoretically possible to achieve a polyatomic ion attenuation factor of around 1 million with only ~1% loss of analyte ions.

For a better understanding of the invention and to show how it may be performed, embodiments thereof will now be described, by way of non-limiting example only, with reference to the accompanying drawings.

DETAILED DESCRIPTION OF THE EMBODIMENTS

Figure 1:
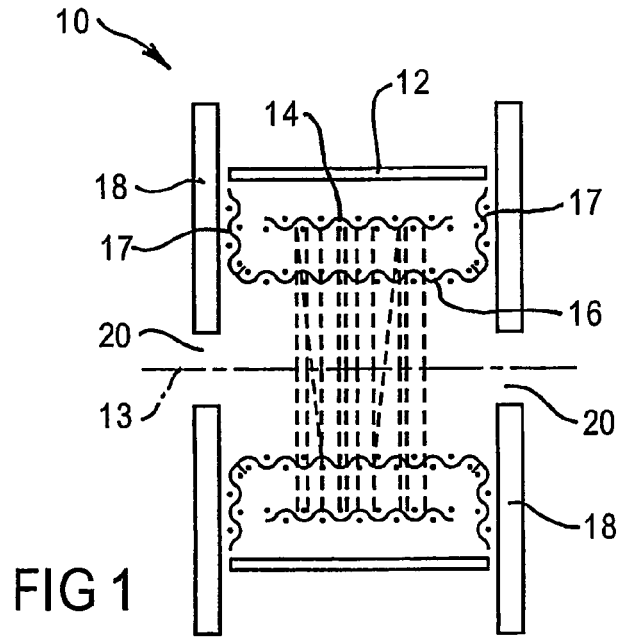
FIG. 1 schematically illustrates an embodiment of an electron generating device for use in a mass spectrometer according to embodiments of the invention.

With reference to FIG. 1 an electron generating device 10 (herein termed an "Electron Reaction Cell", or ERC) for use in mass spectrometers according to embodiments of the invention is shown in cross-section. It comprises a cylindrical cathode 12 (the axis for which is labelled 13) preferably made of tungsten and preferably having a diameter of approximately 14 mm and a wall thickness of approximately 0.1 mm. Such a cathode would require approximately 3 amps current and a 0.5–1 volt voltage drop to reach the required electron-emitting surface temperature of about 2500–3000 K. The potential of cathode 12 should be approximately −10 V relative to ground. A first cylindrical mesh grid 14 (diameter approximately 12 mm) is located inside the cathode cylinder 12 and is used as an electron-attracting electrode. The potential of mesh grid 14 can be any positive voltage from approximately +90 V up to approximately +200V relative to ground. This allows use of the so-called Shottky emission saturation region where the electron space charge is negligible. In this case the cathode 12 temperature, provided the first mesh 14 voltage is constant, can control the electron density. There is a limitation to that voltage of approximately +300V because of the danger of melting the electrodes by the bombardment of emitted electrons. A second mesh grid 16 (diameter approximately 10 mm, approximately 1 mm from the cathode 12 surface) is located inside the first cylindrical mesh grid 14 and is used to establish the electron energy in the Electron Reaction Cell 10. Mesh grid 16 is shown as including radially extending end portions 17, but these may be omitted. The electron energy is defined by the difference of the potential of cathode 12 and the potential of the second mesh grid 16. For 5 eV electron energy the potential of mesh grid 16 must be −5 V if the potential of cathode 12 is −10V. The mesh grid 16 optical transparency is approximately 70%. The ERC 10 includes end plates 18 which define entrance and exit apertures 20. These must be set at negative voltages to trap the electron population inside the cell 10. The spacing of end plates 18 provides a predetermined path length for the beam of particles to pass through the population of electrons.

Considering, for example, operation of the cell 10 with the first mesh grid 14 at +90V., the second mesh grid 16 at −5 V and the cathode 12 at −10V. Using Child-Langmuir law, the maximum current $I_e$ drawn from the cathode 12 is $I_e$=~250 mA/cm$^2$. Taking into consideration the emitting surface of cathode 12 is approximately 4 cm$^2$ per 1 cm$^3$ of volume and the transparency of the mesh grid is 0.7, the electron current into the middle part of the cell 10 could be up to 1 A/cm$^3$·0.7$^2$=0.5 A/cm$^3$. It means $3\times10^{19}$ electrons enter the middle part of the cell every second. If the electron residence time in the middle part is 1 ms this gives at least $3\times10^{13}$ electrons per cm$^3$. If the ERC 10 were to be surrounded by a co-axial magnetic field, the ERC would be able to hold electrons inside for a relatively long time.

An ERC 10 can be located anywhere behind the skimmer cone, i.e. in the second or third chamber of a conventional ICP-MS instrument. However use of a "low internal background mass-analyser" would be necessary, because the metastable atoms produced by the ERC 10 would otherwise lead to excessive continuous background. If the ERC 10 is in the third chamber it would be positioned slightly away from the entrance aperture to allow the residual gas pressure to drop to less than $10^{-4}$ Torr.

Figure 2:
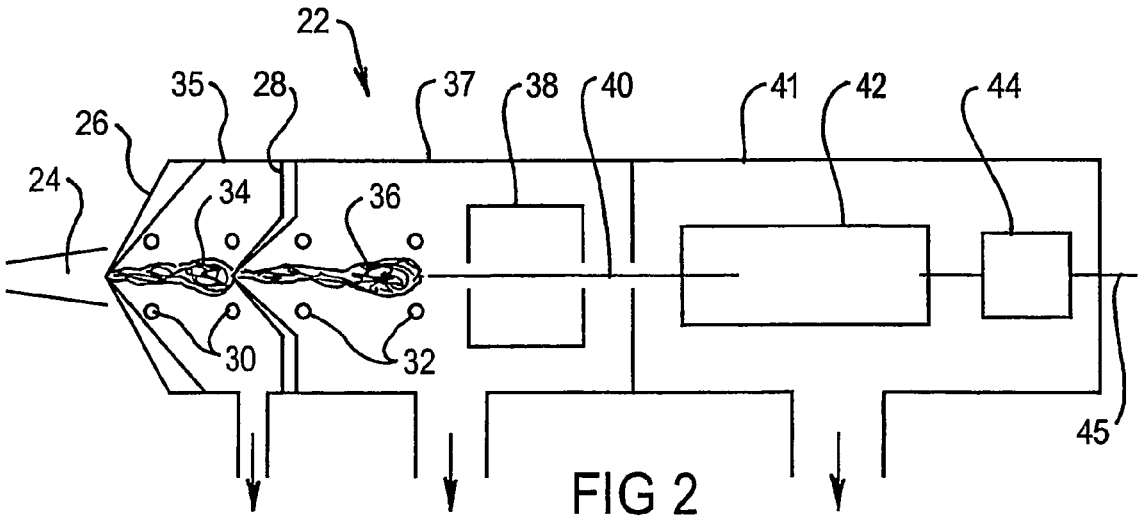
FIG. 2 schematically illustrates a first embodiment, namely an ICP-MS in which a magnetic field is used to establish a population of electrons.

With reference to FIG. 2, an embodiment of an ICP-MS 22 according to an embodiment of the invention is shown which employs magnetic fields to confine plasma ions and electrons to provide the electron population without the use of an ERC10. Such an embodiment is referred to as a Magnetohydrodynamic Magnetic mirror system. It preserves original plasma electrons for ion-electron dissociative combination to attenuate polyatomic and doubly charged ion interferences. The ICP-MS 22 has a source means 24, that is an inductively coupled plasma, for atomising a portion of a sample which is entrained into the plasma 24. The plasma and atomised sample 24 impinges on a sampler cone 26, which in combination with a skimmer cone 28 forms an interface between the atmospheric pressure plasma 24 and a mass spectrometer. Such an interface is known in the art. Means for providing confined populations of electrons in the form of coils 30 and 32 are shown located behind, respectively, the sampler cone 26 and the skimmer cone 28. These coils are for creating an axial magnetic field that causes ions and electrons from plasma 24 to be at least temporarily confined in regions 34 and 36, and thereby favour dissociative recombination of polyatomic ions and doubly charged ions and electrons according to the invention. Region 34 is contained in evacuable chamber 35 (that is, the first chamber) of the mass spectrometer 22 and region 36 is contained in the second evacuable chamber 37 of the mass spectrometer 22. On emerging from region 36, all ions that have not undergone recombination with electrons are focussed by ion optics system 38 within chamber 37 to form an ion beam 40. Ion beam 40 then enters mass analyser 42 contained in a third evacuable chamber 41 of the mass spectrometer 22 and ions are separated according to their mass-to-charge ratio and are subsequently detected by an ion detector 44. The output 45 of the ion detector 44 is then processed to produce a mass spectrum as is known in the art.

According to the invention, either coil 30 or coil 32 alone may be provided in the ICP-MS 22.

In the various following embodiments, the same reference numerals as are used in FIGS. 1 and 2 are used to indicate corresponding components. Also, depiction of the chambers 35, 37 and 41 has been omitted for clarity.

Figure 3:
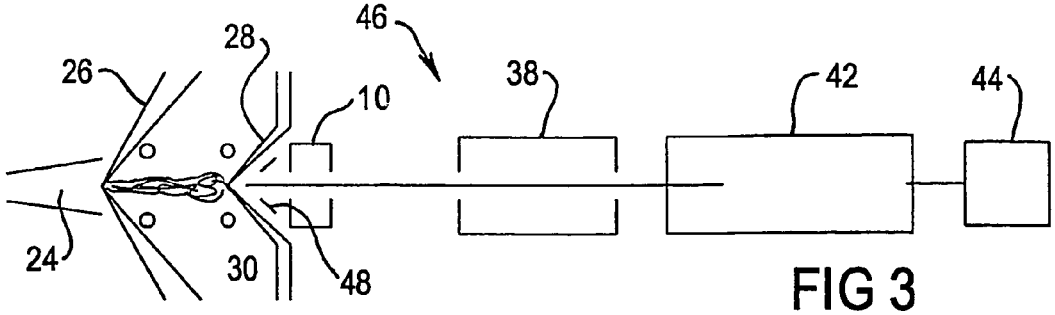
FIG. 3 schematically illustrates a second embodiment, namely a mass spectrometer in which both a magnetic field and an electron generating device are used.

FIG. 3 schematically illustrates another ICP-MS 46 in which the coil 32 of the FIG. 2 embodiment 22 is replaced with an extraction electrode 48 followed by an ERC 10 as in FIG. 1. The extraction electrode 48 is operated at a selectable potential in the range 0 to −1000V to direct positive ions into the cell 10. Otherwise the components are the same as in the FIG. 2 embodiment.

Figure 4:
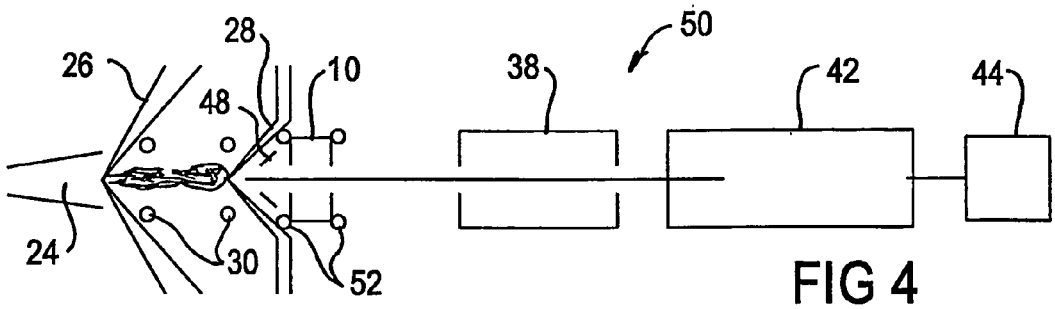
FIGS. 4 to 8 schematically illustrate further embodiments using various combinations of magnetic fields and electron generating devices to establish electron populations for attenuating interfering ions.

FIG. 4 schematically illustrates a modification of the embodiment of FIG. 3. In this embodiment, an ICP-MS 50 includes, in addition to the components of the FIG. 3 embodiment 46, a coil 52 to establish an axial magnetic field inside the ERC 10. This has the effect of increasing residence time of atoms and ions in the ERC 10.

Figure 5:
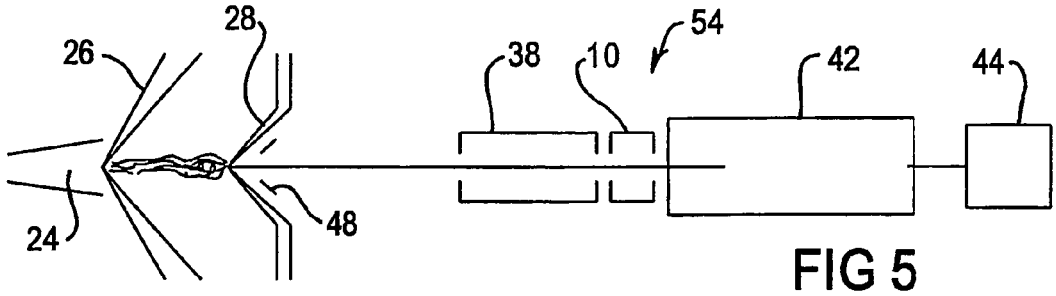

The embodiment of an ICP MS 54 shown in FIG. 5 is similar to the FIG. 3 embodiment, except that the ERC 10 is located after the ion optics system 38 and in front of the mass analyser 42. An ERC 10 may be placed at any convenient location in the ion path between a sampler cone 26 and mass analyser 42. Furthermore, coils such as 30, 32 and/or 52 (as in FIGS. 2 and 4) for establishing axial magnetic fields may be used in the ICP-MS 54.

Figure 6:
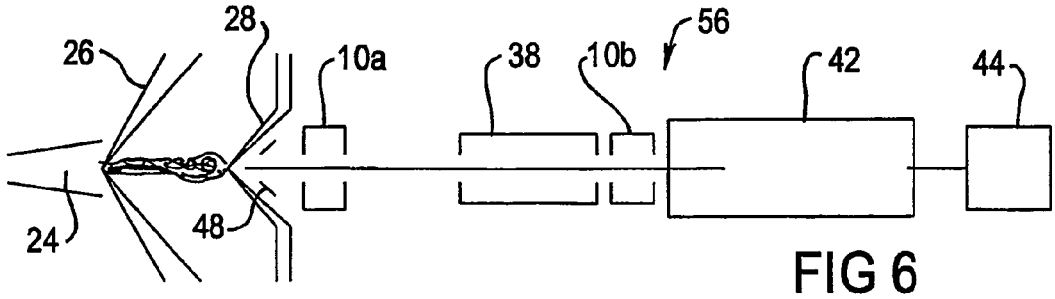

FIG. 6 illustrates an ICP-MS embodiment 56 which employs two ERC's 10, respectively labelled 10*a* and 10*b*, in the ion path. ERC 10*a* is located directly behind extraction electrode 48 and ERC 10*b* is located directly in front of mass analyser 42. Coils such as 30, 32 and/or 52 (as in FIGS. 2 and 4) for establishing axial magnetic fields may be used in the ICP-MS 56.

Figure 7:
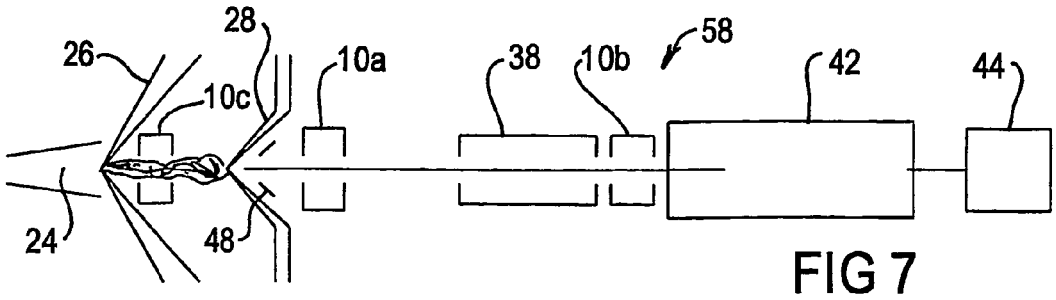

FIG. 7 shows an ICP-MS 58 that is similar to the FIG. 6 embodiment 56 except it includes a third ERC 10*c* directly after the sampler cone 26. As in previous embodiments, coils such as 30, 32 and/or 52 for establishing axial magnetic fields may be used in the ICP-MS 58.

Figure 8:
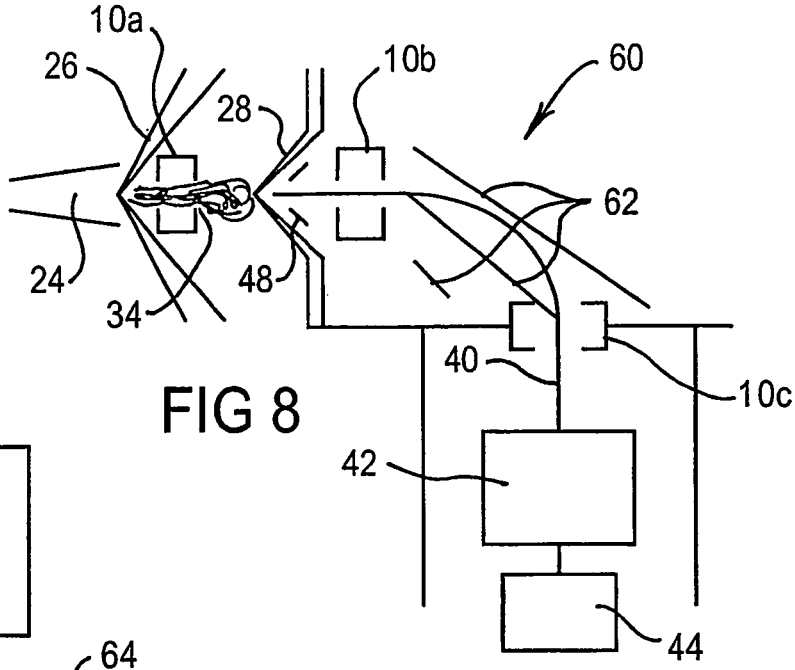

FIG. 8 schematically shows an ICP-MS 60 which utilises a reflective ion optics system 62 (instead of a transmissive system 38 as in the previous embodiments) to cause ion beam 40 to bend through 90°. A first ERC 10*a* is located directly behind sampler cone 26 a second ERC 10*b* is located directly behind extraction electrode 48 after skimmer cone 28 and a third ERC 10*c* is located directly in front of the mass-analyser 42.

Figure 9:
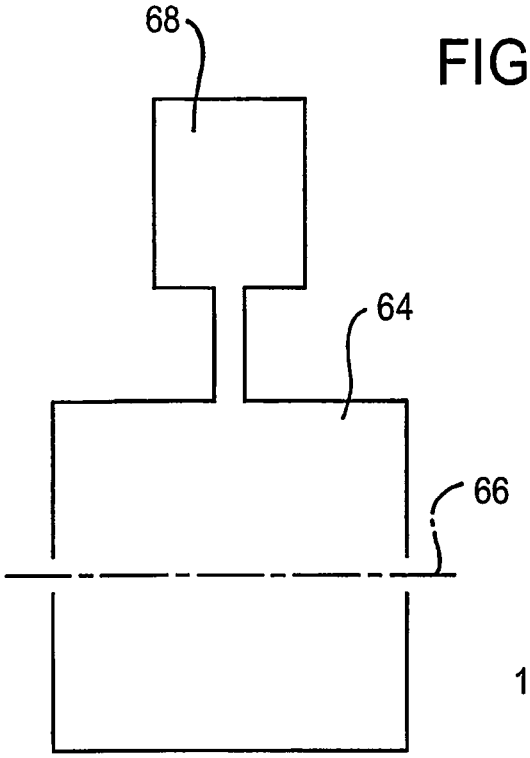
FIG. 9 schematically illustrates a reaction cell that can be used to establish a population of electrons, and FIG. 10 schematically illustrates a modification of the electron generating device of FIG. 1.

FIG. 9 schematically illustrates another reaction cell 64 which may be included in a mass spectrometer 22 as in FIG. 2 in place of the coils 30 and 32. Reaction cell 64 may be located, for example, in chamber 37 following the skimmer cone 28 for a beam of particles 66 therefrom, containing elemental sample ions and interfering polyatomic or doubly charged ions, to pass through the cell 64. Alternatively respective reaction cells 64 may be located in place of the cells 10*a*, 10*b*, 10*c* in FIG. 8. Associated with reaction cell 64 is a plasma generating means 68 for supplying plasma into the reaction cell 64 whereby the plasma electrons provide the required population of electrons for the interfering polyatomic or doubly charged ions preferentially to undergo ion-electron recombination and thus dissociation thereby removing a significant number of them from the beam 66.

Figure 10:
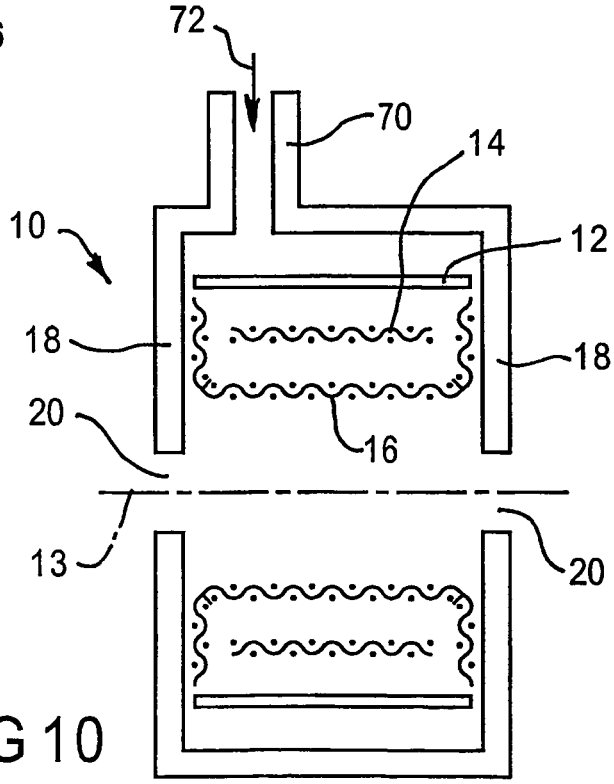

FIG. 10 schematically illustrates a modification of an ERC 10 as in FIG. 1 which may be used in the embodiments of FIGS. 3–8 in place of the ERCs therein. The same reference numerals as in FIG. 1 have been used to indicate the corresponding parts. The modification is that an inlet 70 is provided for supplying an ionisable gas 72, preferably hydrogen, into the ERC 10. Gas 72 undergoes electron impact ionisation by electrons emitted from electrode 12 in the region between electrodes 14 and 16. Ions so produced reduce possible electron space charge effects which might occur in the central part of the ERC 10 due to excessive electron density. Using hydrogen as the ionisable gas is preferred. First, because of its low mass and therefore it causes low scattering losses of analyte ions. Secondly, hydrogen neutrals have high reactivity with argon ions. This brings about reaction of argon ions with hydrogen forming hydrogen-argon ions. Formed hydrogen-argon ions can be removed effectively later by electron—molecular ion reactions in the ERC 10.

From the above description, for the ion-electron recombination and thus dissociation process to prevail over the reverse associative conversion process, the electron number density ($n_e$) needs to be greater than $10^{11}$ $cm^{-3}$ and the low pressure (P) less than 10 Torr. Also, the free electron energy (Ee) needs to be greater than 0.01 eV to avoid enhancing three body radiative recombination relative to the desired dissociative recombination process, and less than 5 eV to avoid additional electron impact ionisation of neutral and metastable particles. Ideally, a free electron energy ($E_e$) of approximately 1 eV is established for the population of electrons. Given the means for providing a population of electrons (for example a coil such as 30 or 32, or an ERC such as 10) is contained in an evacuable chamber 35 or 37 of a mass spectrometer, the low pressure establishable in the region containing the population of electrons will be the typical pressure at which the relevant chamber is maintained, for example 1–10 Torr for first chamber 35 of an ICP-MS 22, $10^{-3}$–$10^{-4}$ Torr for second chamber 37 and $10^{-5}$–$10^{-6}$ Torr for third chamber 41. For an ERC 10 into which gas is supplied (as in FIG. 10), the pressure will be higher as determined by the size of apertures 20, but must be maintained below 10 Torr, and ideally is about $10^{-2}$ Torr. Likewise the pressure within a reaction cell 64 (FIG. 9) is establishable to be lower than 10 Torr via the pressure within the pumped chamber which contains the cell 64, the pressure of the supplied plasma, and the size of entry and exit apertures of the cell 64.

It is furthermore shown above that at electron population of electron number density ($n_e$) of approximately $10^{13}$ $cm^{-3}$ at a free electron energy of approximately 1 eV, a path length of 1 cm through the electron population could attenuate interferences by a factor of 32 for a signal attenuation of 0.5% ($\alpha Ar_2/\alpha C_s^+$=32/1.005) whereas for an electron number density of $10^{14}$ $cm^{-3}$, the interferences attenuation is possibly $10^{15}$ for a signal attenuation of 2.5% ($\alpha Ar_2/\alpha Cs^+$ $=10^{15}/1.025$). For an electron number density of $10^{13}$ $cm^{-3}$ at a path length of 4 cm, with free electron energy of approximately 1 eV, the interferences attenuation could be $10^6$ for a signal attenuation of 1% ($\alpha Ar_2/\alpha Cs^+=10^6/1.01$). For an electron number density of $10^{14}$ $cm^{-3}$ at a 4 cm path length, the interferences attenuation could be $10^{60}$ for a signal attenuation of 10%.

Based on the above and particularly the figures in Table 4, it is considered that the viable outer limits for the four parameters involved are:

I. electron number density ($n_e$):>$10^{11}$ $cm^{-3}$ to $10^{14}$ $cm^{-3}$

II. free electron energy ($E_e$)>0.01 eV to <5 eV.

III. pressure (P)<10 Torr

IV. path length: 1 to 4 cm

Preferably the free electron energy ($E_e$) is approximately 1 eV and the pressure P is <$10^{-3}$ Torr.

Preferably the electron number density ($n_e$) is between $10^{12}$–$10^{14}$ $cm^{-3}$, more preferably it is $10^{13}$–$10^{14}$ $cm^3$.

Preferably the path length is between 2 to 4 cm, more preferably it is between 3 to 4 cm.

The invention described herein is susceptible to variations, modifications and/or additions other than those specifically described and it is to be understood that the invention includes all such variations, modifications and/or additions which fall within the scope of the following claims.

The invention claimed is:

1. A mass spectrometer for elemental analysis of a sample comprising:

source means for atomising a portion of the sample, said source means being a plasma ion source;

means for extracting a beam of particles from the source means, wherein the beam contains elemental sample ions and interfering polyatomic or doubly charged ions;

means for providing a population of electrons in a region through which the beam of particles is passed and which defines a predetermined path length for the particles through the electron population, said region being located within an evacuable chamber of the mass spectrometer whereby a low pressure is establishable in said region, the population of electrons having an electron number density and free electron energy which, together with said predetermined path length and low pressure, provide for interfering polyatomic or doubly charged ions preferentially to undergo ion-electron recombination and thus dissociation thereby removing a significant number of the interfering ions from the beam of particles, said means for providing a population of electrons comprising a device for providing a magnetic field axially of the beam of particles for confining said population of electrons from the plasma within said region further defined by the magnetic field; and a mass analyser and an ion detector for receiving ions from the beam of particles after it has passed through the population of electrons for spectrometric analysis whereby concentrations of different elements in the sample are determinable.

2. The mass spectrometer as claimed in claim 1, wherein the device for providing the magnetic field is an electric coil, and the mass spectrometer comprises an interface between the plasma ion source and the mass analyser, the interlace comprising a sampling cone followed by a skimmer cone, and wherein the coil is located after the sampling cone.

3. The mass spectrometer as claimed in claim 2, wherein the coil is located between the sampling and the skimmer cones.

4. The mass spectrometer as claimed in claim 2, wherein the coil is located between the skimmer cone and the mass analyser.

5. The mass spectrometer as claimed in claim 2, including an additional coil for providing a magnetic field axially of the beam of particles for temporarily confining electrons from the plasma thereby providing an additional population of electrons through which the beam of particles is passed, the additional coil being located after the skimmer cone and after the first defined coil.

6. The mass spectrometer as claimed in claim 1, wherein the means for providing a population of electrons includes a reaction cell through which the beam of particles is passed, the reaction cell being located within said evacuable chamber of the mass spectrometer; and plasma generating means associated with the reaction cell for supplying a plasma into the reaction cell whereby the plasma electrons constitute said population of electrons.

7. A mass spectrometer for elemental analysis of a sample comprising:

source means for atomising a portion of the sample;

means for extracting a beam of particles from the source means, wherein the beam contains elemental sample ions and interfering polyatomic or doubly charged ions;

means for providing a population of electrons confined in a region through which the beam of particles is passed and which defines a predetermined path length for the particles through the electron population, said means comprising an electron generating device and said population of electrons comprising a cloud of electrons derived from said electron generating device and further comprising means to confine said cloud of electrons to said region, said region being located within an evacuable chamber of the mass spectrometer whereby a low pressure is establishable in said region, said means for providing the population of electrons also allowing establishment of an electron number density and free electron energy for the population of electrons which, together with said predetermined path length and low pressure, provide for interfering polyatomic or doubly charged ions preferentially to undergo ion-electron recombination and thus dissociation thereby removing a significant number of the interfering ions from the beam of particles; and a mass analyser and an ion detector for receiving ions from the beam of particles after it has passed through the population of electrons for spectrometric analysis whereby concentrations of different elements in the sample are determinable.

8. The mass spectrometer as claimed in claim 7, wherein the means for confining said cloud of electrons is a device for providing a magnetic field axially of the beam of particles; and the source means is a plasma ion source; an interface is disposed between the plasma ion source and the mass analyser, the interface comprising a sampling cone followed by a skimmer cone, and wherein the electron generating device is located between the sampling cone of the interface and the mass analyser.

9. The mass spectrometer as claimed in claim 8, wherein the electron generating device comprises a tubular electron emitting cathode, within which is located a tubular mesh electrode that is operable as an electron attracting anode; and plates are located at the ends of the tubular cathode to which a negative potential is applicable for trapping electrons within the device, the plates having apertures for entry and exit of the beam of particles, the spacing between the plates defining said predetermined path length.

10. The mass spectrometer as claimed in claim 9, wherein the electron generating device includes a second tubular mesh electrode located within the first defined tubular mesh electrode, the second tubular mesh electrode being operable to establish said free electron energy.

11. The mass spectrometer as claimed in claim 8, wherein the electron generating device is located between the sampling cone and the skimmer cone.

12. The mass spectrometer as claimed in claim 8, wherein the electron generating device is located behind the skimmer cone.

13. The mass spectrometer as claimed in claim 8, wherein the electron generating device is located in front of the mass analyser.

14. The mass spectrometer as claimed in claim 8, comprising at least one additional electron generating device to provide at least an additional population of electrons through which the beam of particles is passed, the at least two electron generating devices being located between the sampling cone of the interface and the mass analyser.

15. The mass spectrometer as claimed in claim 8, additionally comprising a device for providing a magnetic field axially of the beam of particles for temporarily confining electrons from the plasma within a region defined by the magnetic field to thereby provide an additional population of electrons through which the beam of particles is passed.

16. The mass spectrometer as claimed in claim 8, wherein electron generating device comprising means for supplying an ionisable gas into the electron generating device.

17. A method for elemental mass spectrometry of a sample comprising, removing polyatomic or doubly charged ion interferences, the method comprising the steps of:

generating a plasma by which a portion of said sample is atomised;

atomising such portion of the sample within said plasma and creating a beam of particles therefrom by combined action of a sampling cone and skimmer cone, wherein the beam contains elemental sample ions and interfering polyatomic or doubly charged ions;

establishing in a region at a predetermined low pressure, a population of electrons having an electron number density and free electron energy;

providing a magnetic field to localize the population of electrons, the magnetic field being located and shaped to confine electrons of said population to said region through which the beam of particles is passed, passing the beam of particles through the population of electrons, the beam of particles having a predetermined path length through the population of electrons;

wherein said electron number density, free electron energy, low pressure and path length are such that interfering polyatomic or doubly charged ions contained in the beam preferentially undergo ion-electron recombination and thus disassociation thereby removing a significant quantity of such ions from the beam; and spectrometrically analysing the masses of ions in the resultant beam to determine the elemental composition of the sample.

18. The method as claimed in claim 17, comprising providing a magnetic field to establish the population of electrons, the magnetic field being located and shaped to confine said population of electrons to said region through which the beam of particles is passed.

19. The method as claimed in claim 18, comprising supplying in such population of electrons from said plasma into said region whereby the plasma electrons constitute said population of electrons.

20. The method as claimed in claim 17, wherein the population of electrons is established by creating electrons using an electron generating device, and confining the so created electrons to establish the population of electrons.

21. The method as claimed in claim 20, comprising providing a magnetic field which is located and shaped to confine the created electrons.

* * * * *